US005192116A

United States Patent [19]

Turner et al.

[11] Patent Number: 5,192,116

[45] Date of Patent: Mar. 9, 1993

[54] GANTRY-TYPE MOBILE MINING MACHINE

[75] Inventors: John Turner, Renton; Neil J. Dahmen, Seattle, both of Wash.

[73] Assignee: The Robbins Company, Kent, Wash.

[21] Appl. No.: 706,402

[22] Filed: May 28, 1991

[51] Int. Cl.[5] ..... E21C 29/26; E21C 31/08

[52] U.S. Cl. ..... 299/75; 299/31

[58] Field of Search ..... 299/31, 33, 72, 73, 299/75, 78

[56] References Cited

U.S. PATENT DOCUMENTS

| | | | |
|---|---|---|---|
| 2,776,824 | 1/1957 | Osterhus et al. | 299/75 |
| 3,307,879 | 3/1967 | Bergmann | 299/64 |
| 3,726,562 | 4/1973 | Wharton | 299/12 |
| 3,873,157 | 3/1975 | Stoltefuss et al. | 299/31 |
| 3,929,378 | 12/1975 | Frenyo et al. | 299/64 |
| 3,965,995 | 6/1976 | Sugden et al. | 175/57 |
| 4,045,088 | 8/1977 | Bechem | 299/31 |
| 4,111,488 | 9/1978 | Sigott et al. | 299/10 |
| 4,230,372 | 11/1980 | Marten | 299/39 |
| 4,312,541 | 1/1982 | Spurgeon | 299/31 |
| 4,548,442 | 10/1985 | Sugden et al. | 299/10 |
| 4,838,615 | 6/1989 | Oldham | 299/75 X |
| 5,087,102 | 2/1992 | Kiefer | 299/75 X |

FOREIGN PATENT DOCUMENTS

| | | | |
|---|---|---|---|
| 2723675 | 11/1978 | Fed. Rep. of Germany | 299/75 |

OTHER PUBLICATIONS

"World Tunnelling", issue of Jun., 1991, p. N52, in part showing a Gantry (Portal) Miner, in an advertisement of Advanced Excavation & Cutting Technologies, a Division of Alpine Equipment Corporation, P.O. Box 767, State College, Pa. 16804.

*Primary Examiner*—David J. Bagnell

*Attorney, Agent, or Firm*—Graybeal Jackson Haley & Johnson

[57] ABSTRACT

A gantry-type mobile mining machine includes a cutterwheel having an axis of rotation substantially parallel to the tunnel work face and carried by a boom assembly pivotally movable about an axis also substantially parallel to the tunnel work face and to the cutterwheel axis of rotation. A rotation assembly supports the boom assembly and cutterwheel and causes rotation of the cutterwheel and the boom assembly about an axis substantially perpendicular to the tunnel work face and to the cutterwheel axis of rotation, so that radial motion of the cutterwheel is possible in any desired direction generally parallel to the tunnel work face. A traverse assembly supported on a frame causes traverse movement of the cutterwheel, boom assembly and rotation assembly on the frame. Thrust cylinders thrust forward as a unit the cutterwheel, boom assembly and rotation assembly relative to the frame. A holding assembly secures the frame in the tunnel during thrusting by the thrust cylinders. A transport assembly supports and moves the frame of the machine during repositioning and tramming of the machine relative to the work face.

19 Claims, 8 Drawing Sheets

GANTRY-TYPE MOBILE MINING MACHINE

BACKGROUND OF THE INVENTION

The invention is in the field of mine tunneling machines, such as machines for cutting variable cross-section mining tunnels.

The most common known method of forming large mining tunnels in rock is the drill-and-blast method using explosives which has many disadvantages, one of which is that it is very hazardous. Thus, there has been a long-felt need for a mobile mining machine capable of successfully cutting large mining tunnels in rock by mechanical means in order to replace the use of explosives.

Several prior art patents show mining machines which appear to be capable of rotating a cutterhead about a horizontal axis and swinging it across a work face about a vertical axis. Typical of these are Osterhus et al, U.S. Pat. No. 2,776,824; Bergmann, U.S. Pat. No. 3,307,879; Frenyo et al, U.S. Pat. No. 3,929,378; Sigott et al, U.S. Pat. No. 4,111,488; and Marten, U.S. Pat. No. 4,230,372. All of these prior art patents disclose machines employing toothed or ripper cutter elements rather than disc cutters.

Sugden et al, U.S. Pat. No. 4,548,442, teaches a mobile mining machine having a wheel-like cutterhead assembly and having a swing boom assembly located forward of a pitch boom assembly.

Sugden at al, U.S. Pat. No. 3,965,995 discloses a machine for boring a large diameter vertical hole having a rotatable cutterwheel mounted on the lower end of a tubular support. The cutterwheel is rotatable about the tubular support on an axis perpendicular to the axis of rotation of the cutterwheel. To bore the vertical hole, the rotating cutterwheel is advanced into the ground to make a first cut. The cutterwheel is then rotated on the tubular support to make a subsequent cut across the first cut. This process is repeated until the hole is bored.

Bechem, U.S. Pat. No. 4,045,088, discloses a mining machine which is characterized by oscillation of a so-called drilling head about a vertical pivot axis to arcuately drive a slot cavity, the head and the rotatable disc cutters carried thereby being oscillated through a horizontal angle of about 120 degrees. Plural disc cutters are canted in a diverging manner. No cutter movement is contemplated other than horizontal oscillation.

Stoltefuss et al, U.S. Pat. No. 3,873,157, discloses a tunneling or mining machine with the cutting device rotatably mounted on the forward end of a boom which is vertically and horizontally pivotable. The cutting arrangement involves two narrow wheels or rollers carrying pick-like cutters.

Spurgeon, U.S. Pat. No. 4,312,541, discloses a trench cutting machine comprising a main body assembly and a cutting wheel assembly. This coal mining machine moves plural rows of disc cutters horizontally about a substantially vertical axis to facilitate discharge to a conveyor. A cylinder is mounted transversely on the main body assembly and carries a pair of pistons which extend axially from each end of the cylinder. Gripper pads are provided on each piston to bear against the side walls of the trench. Each piston has an end face within the cylinder which, together with an inner side wall of the cylinder, comprises a pressure chamber adapted to force the pads against the trench. The main body and its cylinder are free to move laterally relative to the pistons when the cylinder is pressurized. Extensible arms are provided between the pistons and the main body assembly for forcing the main body assembly and its cutting wheel forwardly to progressively cut a trench. A steering assembly is provided to shift the main body assembly laterally relative to the pistons and about the central axis of the cutting wheel.

Also known is Wharton, U.S. Pat. No. 3,726,562, which discloses a coal mining machine having a cutterhead in the shape of a shallow cone rotatably mounted on the forward end of an elongate boom. The cutterhead, although not described in detail, appears to involve a series of picks as the cutting elements. It is not clear from the disclosure of the patent how the cutterhead is rotated and the patent disclosure does not contemplate any particular correlation between the rate of cutterhead rotation and the rate of cutterhead swing. The cutterhead is swingable both horizontally and vertically.

A need thus exists for a mobile mining machine having a cutterwheel assembly carried by a boom assembly in which the cutterwheel and the boom orbit, and optionally traverse, the mobile mining machine. The above configuration, as differentiated from prior art mining machines having a swing boom assembly and a pitch boom assembly, allows the cutting of a tunnel either having a low height to width ratio or a substantially equal height to width ratio, and optionally having no roof crown.

A need also exists for a mobile mining machine having a cutterwheel that is manipulatable so that its axis of rotation can take any substantially parallel direction with respect to the tunnel work face to more efficiently cut the lower corners of the tunnel.

A need also exists for a mobile mining machine having the above configuration in which the mobile mining machine has a gantry-type frame defining an inner portion substantially devoid of components. This gantry configuration allows workmen and mining support vehicles to work under the mobile mining machine (gathering muck, for example) during the mining operation.

SUMMARY OF THE INVENTION

A gantry-type mobile mining machine includes a cutterwheel having a plurality of peripheral mounted roller cutter units. The cutter wheel is power driven about an axis of rotation substantially parallel to the tunnel work face and substantially perpendicular to the line of advance of the mobile mining machine. The cutterwheel is carried by a boom assembly that is pivotal about an axis substantially parallel to the tunnel work face and to the cutterhead axis of rotation, and substantially perpendicular to the line of advance of the mobile mining machine.

A rotation assembly including a boom support shaft and a rotatable boom yoke supports the boom assembly and cutterwheel. The rotation assembly causes rotation of the cutterwheel and the boom assembly about an axis substantially perpendicular to the tunnel work face and to the cutterwheel axis of rotation, and substantially parallel to the line of advance of the mobile mining machine.

Thrust cylinders thrust forward as a unit the cutterwheel, boom assembly and rotation assembly relative to the main portion of the mobile mining machine.

The above configuration provides a mobile mining machine having four degrees of freedom of motion from the perspective of the cutterwheel units. Specifically, these four degrees of freedom of motion are provided by (1) rotation of the cutterwheel about an axis parallel to the tunnel work face and perpendicular to the line of advance of the mobile mining machine; (2) pivotal movement of the boom assembly about an axis parallel to the tunnel work face and perpendicular to the line of advance of the mobile mining machine and to the axis of rotation of the cutterwheel; (3) rotation of the rotation assembly about an axis perpendicular to the tunnel work face and to the axis of rotation of the cutterwheel and parallel to the line of advance of the mobile mining machine; and (4) thrusting of the cutterwheel and boom assembly along an axis perpendicular to the tunnel work face and to the cutterwheel axis of rotation and parallel to the line of advance of the mobile mining machine. In this manner radial motion of the cutterwheel is possible in any desired direction generally parallel to the tunnel work face and perpendicular to the line of advance of the mobile mining machine.

In the preferred embodiment, the mobile mining machine also includes a traverse assembly supported on a frame and comprised of a traverse housing slidable on traverse ways to cause traverse movement of the cutterwheel, boom assembly and rotation assembly relative to the frame. This traverse assembly thus provides a fifth degree of freedom of movement of the cutterwheel as a result of the present invention.

The frame supporting the traverse assembly is preferably a gantry-type frame comprised of first and second gantry side frame portions connected by a gantry top frame portion. The gantry type-frame defines a void under the mobile mining machine for access to the muck therethrough and for ingress and egress of workers and associated machinery.

The machine holding assembly is comprised of jacks on the gantry-type frame, gripper arms pivotally attached to the gantry frame, gripper shoes on the gripper arms, and gripper cylinders connected to both the traverse ways and gripper shoes. This holding assembly secures the machine in the tunnel during mining by extension of the jacks and gripper cylinders, and configures the mobile mining machine for either tramming or repositioning for the next mining stroke by retraction of the jacks and gripper cylinders.

Crawlers on the gantry frame transport the mobile mining machine when in the tramming or repositioning configuration.

BRIEF DESCRIPTION OF THE DRAWINGS

These and other features of the present invention will be evident when considered in light of the following specification and drawings in which.

DETAILED DESCRIPTION OF THE PREFERRED EMBODIMENT

Figure 1:
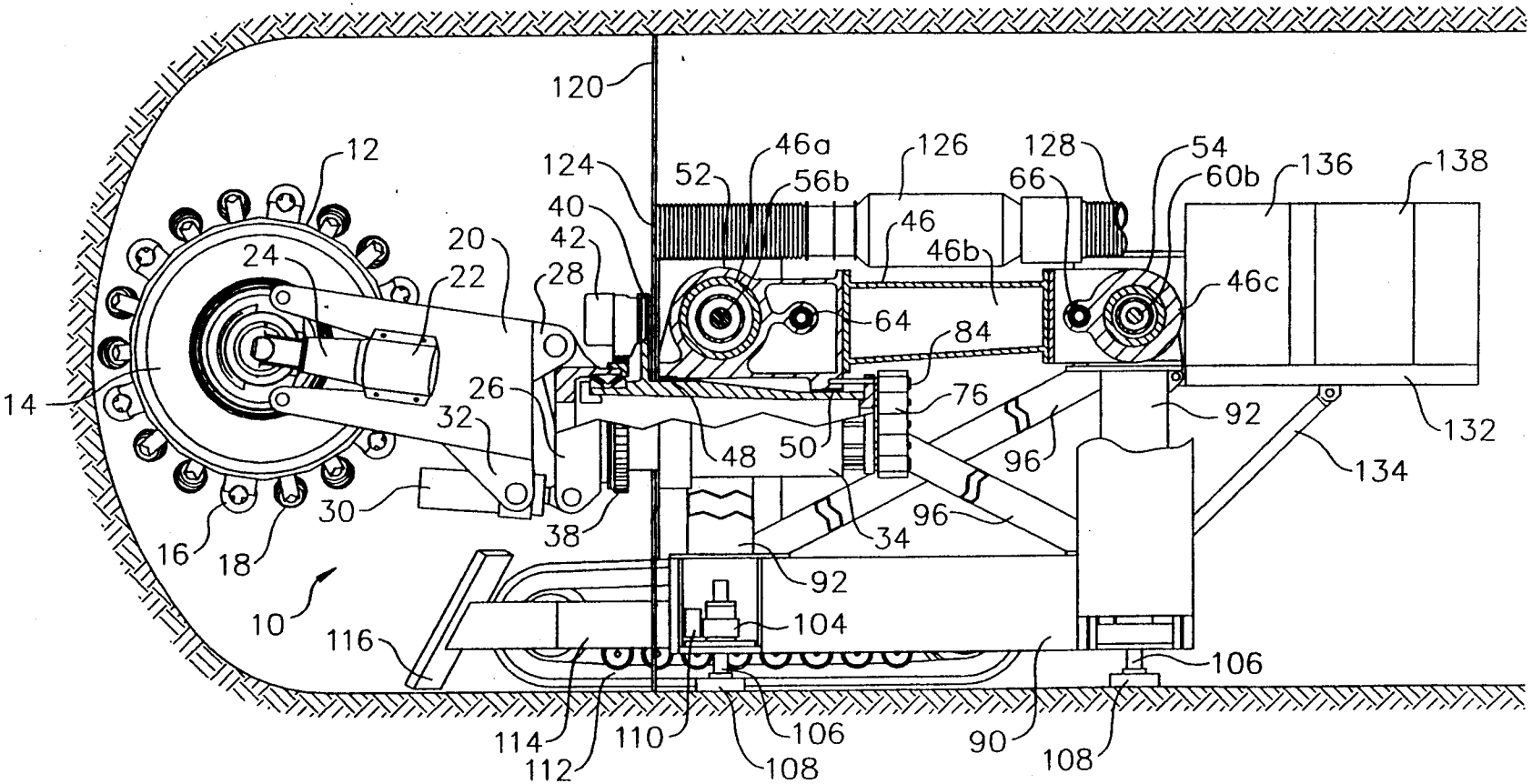
FIG. 1 is a side elevational view, partially in section, of a mobile mining machine typifying the present invention.
Figure 2:
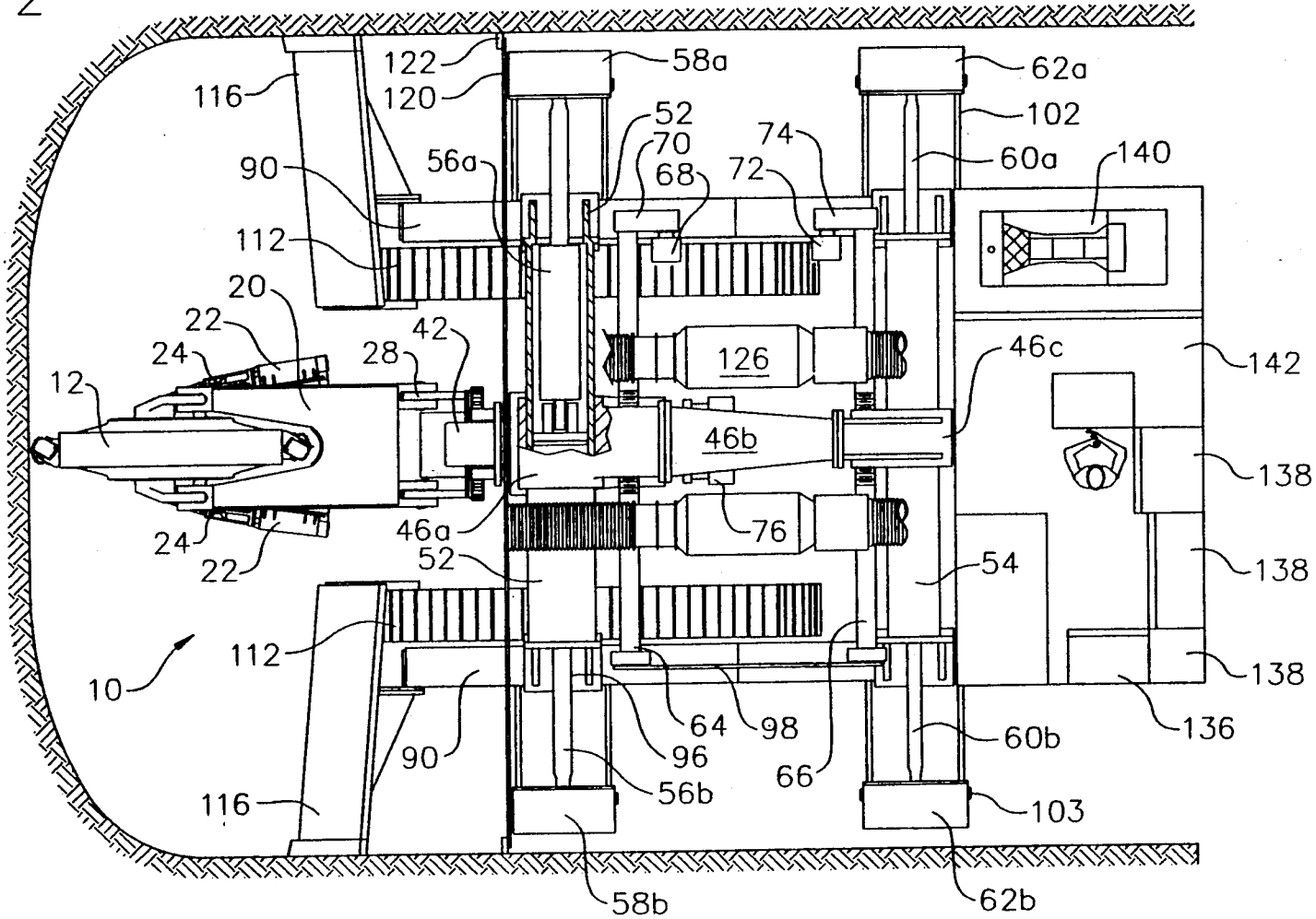
FIG. 2 is a top view, partially in section, of the mobile mining machine of FIG. 1.

Referring to FIGS. 1-7, the preferred embodiment of the invention is the mobile mining machine 10 which, as shown in FIGS. 1 and 2, includes cutterwheel 12. The term "mobile mining machine" is to be construed as including machines employed in any and all of mining, tunneling and excavation operations. The cutterwheel 12 has a transverse, horizontal axis drum 14 on which are peripherally mounted a plurality of disk cutters 16 and gauge cutters 18. Drum 14 is rotatably connected to boom 20, and is powered by electric drive motor 22 through drive train 24 known in the art about an axis of rotation. The axis of rotation is, as described below, substantially parallel to tunnel work face W and is substantially perpendicular to the line of advance L of mobile mining machine 10.

Cutterwheel 12 generates the tunnel work face W by plunging forward along the line of advance L and optionally moving horizontally from side to side as controlled by a traverse mechanism to be described in further detail below. Cutterwheel 12 is axially rotatable in both a clockwise and a counterclockwise direction around a cutterwheel rotation mechanism, to be described in further detail below, that causes orbital movement of cutterwheel 12. This rotation mechanism has an axis of rotation substantially parallel to the line of advance L of mobile mining machine 10 and substantially perpendicular to the axis of rotation of cutterwheel 12 and the tunnel work face W. Additionally, boom 20, by pivoting about its axis, varies the orbital radius of cutterwheel 12 as measured between the axis of rotation of the cutterwheel 12 and the line of advance L of mobile mining machine 10. The axis of rotation of boom 20 is substantially perpendicular the line of advance L of mobile mining machine 10, and is substantially parallel to the tunnel work face W and the axis of rotation of cutterwheel 12 regardless of the orientation of cutterwheel 12. The combination of the above horizontal traversing, and orbiting of cutterwheel 12 with a variable orbital radius allows any combination of horizontal, vertical, arcuate, or angled cuts by cutterwheel 12.

Figure 6:
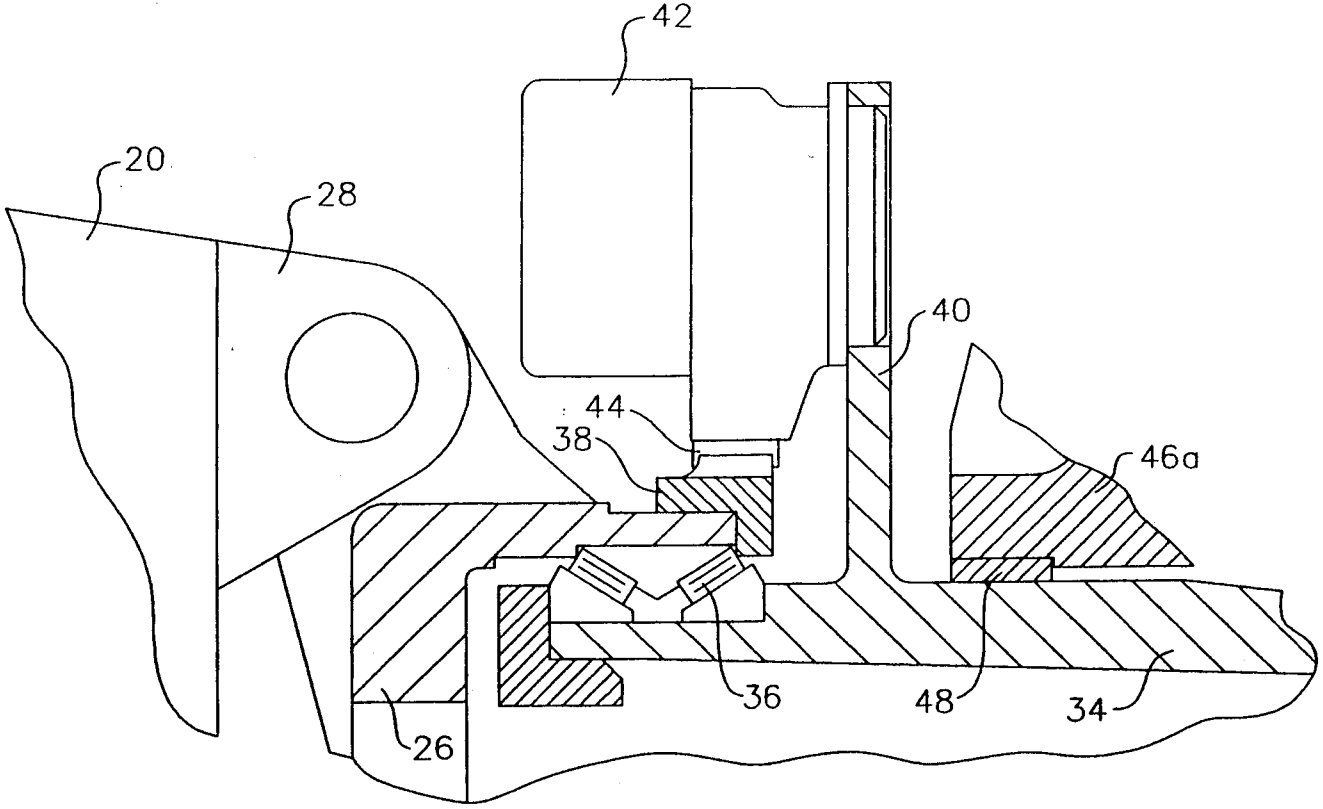
FIG. 6 is an enlarged view, partially in section, of the pitch boom, boom yoke, and boom support shaft of the mobile mining machine of FIG. 1.

The components that vary the orbital radius of cutterwheel 12 from the line of advance L of mobile mining machine 10, as shown in FIGS. 1, 2 and 6, include boom 20. Boom 20 is attached to boom yoke 26 by boom clevis 28 such that boom 20 is rotatable substantially about an axis through boom clevis 28 that is substantially perpendicular to the line of advance L of mobile mining machine 10 and parallel to tunnel work face W and the axis of rotation of cutterwheel 12. Boom cylinders 30 are fixedly attached to boom 20 by boom cylinder clevises 32. Boom cylinders 30 are also secured to boom yoke 26 such that extension and retraction of boom cylinders 30 result in relative planar movement of cutterwheel 12 to alter the orbital radius of cutterwheel 12. As state above, this orbital radius of cutterwheel 12 is measured between the axis of rotation of cutterwheel 12 and the axis of rotation of boom yoke 26 (described below).

The components causing orbital motion of cutterwheel 12 relative to main portion of mobile mining machine 10 will now be described in detail. Again referring to FIGS. 1, 2 and 6, boom support shaft 34, having previously described boom yoke 26 at its forward end, supports pitch boom 20 and cutterwheel 12. Boom yoke 26 is axially rotatable about boom support shaft 34 over boom support bearings 36. The axis of rotation of boom yoke 26 is substantially perpendicular to the tunnel work face W, the pivotal axis of boom 20 and the axis of rotation of cutterwheel 12, and is substantially parallel to the line of advance L of mobile mining machine 10. Ring gear 38 is radially mounted on boom yoke 26, and is fixedly attached thereto. Attached to flange 40 of boom support shaft 34 is boom rotation motor 42. Boom rotation motor 42 includes pinion gear 44 which meshes with ring gear 38. Thus, boom rotation motor 42 powers pinion gear 44, which in turn causes rotation of ring gear 38. Boom yoke 26 thus axially rotates about boom support shaft 34 on boom support bearings 36. This axial rotation of boom yoke 26 in turn causes orbital motion of boom 20 and cutterwheel 12 in either a clockwise or counterclockwise direction.

In another embodiment of the present invention (not shown), boom support shaft 34 includes an opening through the longitudinal axis of boom support shaft 34. A drive shaft passes through the opening and is connected to boom yoke 26. A drive motor turns the drive shaft, thus rotating boom yoke 26, boom 20, and cutterwheel 12.

Now describing the components that cause optional traverse motion of cutterwheel 12 and boom 20, FIGS. 1, 2, 4, and 5 show traverse housing 46 oriented above boom support shaft 34. Specifically, traverse housing 46 includes front shaft traverse housing 46*a*, center traverse housing 46*b*, and rear shaft traverse housing 46*c*. The above three elements are denoted for the purpose of clarity; however, it should be realized that traverse housing 46 is an integral unit. Front shaft traverse housing 46*a* is positioned above boom support shaft 34, and front main bushing 48 and rear main bushing 50 allow relative longitudinal movement of boom support shaft 34, boom 20, and cutterwheel 12 relative to traverse housing 46 for plunging, to be described in further detail below. Forward shaft traverse housing 46*a* contains forward traverse way 52, and rear shaft traverse housing 46*c* contains rear traverse way 54. Front traverse way 52 and rear traverse way 54 are disposed substantially transverse of the longitudinal axis of mobile mining machine 10. When stabilized against the tunnel wall in a manner to be described in detail below, forward traverse way 52 and rear traverse way 54 allow substantially horizontal planar movement of traverse housing 46 thereon by sliding of front shaft traverse housing 46*a* over forward traverse way 52, and sliding of rear shaft traverse housing 46*c* over rear traverse way 54.

Secured within forward traverse way 52 are forward right gripper cylinder 56*a* and forward left gripper cylinder 56*b*. Attached to an end of front right gripper cylinder 56*a* for contact with the tunnel wall is front right gripper shoe 58*a*. Similarly, attached to front left gripper cylinder 56*b* for contact with the tunnel wall is front left gripper shoe 58*b*. Fixedly secured within rear traverse way 54 are rear right gripper cylinder 60*a* and rear left gripper cylinder 60*b*. Attached to an end of rear right gripper cylinder 60*a* for contact with the tunnel wall is rear right gripper shoe 62*a*. Likewise, attached to an end of rear left gripper cylinder 60*b* for contact with the tunnel wall is rear left gripper shoe 62*b*. Extension of front right gripper cylinder 56*a*, front left gripper cylinder 56*b*, rear right gripper cylinder 60*a*, and rear left gripper cylinder 60*b* secures front right gripper shoe 58*a*, front left gripper shoe 58*b*, rear right gripper shoe 62*a* and rear left gripper shoe 62*b* against the tunnel wall. When mobile miner machine 10 is so secured against the tunnel wall, traverse housing 46 is then capable of horizontal planar movement relative to mobile mining machine 10, and, specifically, front shaft traverse housing 46*a* is slidably movable over front traverse way 52 and rear shaft traverse housing 46*c* is slidably movable over rear traverse way 54.

The above mentioned horizontal planar movement of traverse housing 46 over front traverse way 52 and rear traverse way 54 is caused by front traverse screw 64 and rear traverse screw 66, respectively. Front traverse screw 64 is threadedly mated through front shaft traverse housing 46*a*, and is disposed traversely across mobile mining machine 10. Similarly, rear traverse screw 66 is threadedly secured through rear shaft traverse housing 46*c*, and is also transversely disposed across mobile mining machine 10. Front traverse motor 68 and front traverse gearing 70 axially rotate front traverse screw 64, thus causing horizontal planar movement of traverse housing 46 over front traverse way 52 due to the threaded engagement of front traverse screw 64 and front shaft traverse housing 46*a*. Similarly, rear traverse motor 72 and rear traverse gearing 74 axially rotate rear traverse screw 66, thus causing horizontal planar movement of traverse housing 46 over rear traverse way 54 and relative to mobile mining machine 10 based on the threaded engagement of rear traverse screw 66 and rear shaft traverse housing 46*c*. It should be noted that the above described traverse movement of mobile mining machine 10 is optional.

Figure 7:
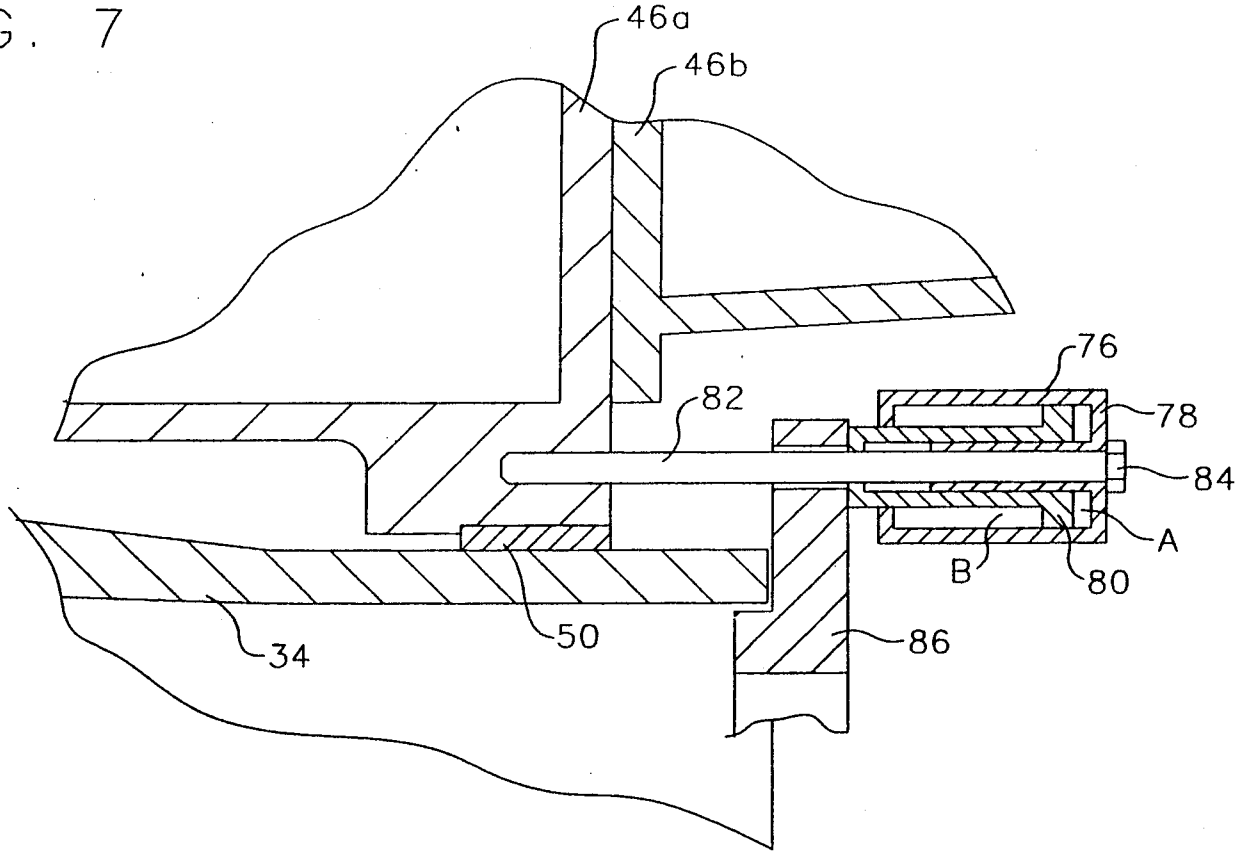
FIG. 7 is an enlarged view, partially in section, of the traverse housing, boom support shaft, and plunge cylinders of the mobile mining machine of FIG. 1.

Now, describing the components of mobile mining machine 10 that cause plunging of cutterwheel 12, boom 20, and boom support shaft 34 fore and aft thereof, FIGS. 1 and 7 show a plurality of plunge cylinders 76, each of which includes an exterior sleeve 78 and an interior piston 80. Plunge cylinders 76 are preferably double acting, hollow plunger design hydraulic cylinders, model no. RRH-10010, manufactured by Enerpac, of Butler, Wis. Stud 82 passes through the central portion of each plunge cylinder 76 and is fixedly secured to exterior sleeve 78 by a fastening means 84, such as a nut or the like. The end of stud 82 not attached to exterior sleeve 78 is threadedly secured to front shaft traverse housing 46*a*. Stud 82 is also slidably mounted on thrust plate 86 of boom support shaft 34 such that boom support shaft 34 moves relative to shaft 82 and plunge cylinder 76. Additionally, the face of interior piston 80 of plunge cylinders 76 adjacent to thrust plate 86 is fixedly secured to thrust plate 86.

In operation, to cause plunging of cutterwheel 12 and boom 20, boom support shaft 34 is thrust forward relative to mobile mining machine 10 by increasing the pressure in right hand chamber A of plunge cylinders 76. This pressure increase causes interior piston 80 to exert a force substantially parallel to the longitudinal axis of mobile mining machine 10 against thrust plate 86 of boom support shaft 34. Thus, boom support shaft 34 is urged relatively forward with respect to front shaft traverse housing 46*a* on front main bushing 48 and rear main bushing 50. In turn, boom 20 and cutterwheel 12 are also urged forward. The above force exerted on flange 86 by interior piston 80 causes relative movement of boom support shaft 34 because exterior sleeve 78 is securedly attached to stabilized front shaft traverse housing 46a by shaft 82.

To recover cutterwheel 12 and boom 20 from the plunge, the pressure in chamber A cf plunge cylinders 76 is decreased (and/or the pressure in chamber B of plunge cylinders 76 is increased) to cause interior piston 80 to retract into exterior sleeve 78. This retraction by interior piston 80 pulls thrust plate 86 of boom support shaft 34 rearwardly relative to stationary front shaft traverse housing 46a due to the fixed attachment between interior piston 80 and thrust plate 86. Thus, boom support shaft 34 is urged rearwardly relative to stationary front shaft traverse housing 46a along front main bushing 48 and rear main bushing 50. In this manner, cutterwheel 12 and boom 20 recover from a plunge.

Next described are the frame support components that allow gripping of mobile mining machine 10 for tunneling, recovery of mobile mining machine 10 for the next tunneling stroke, and tramming of mobile mining machine 10 to a different location. Referring to FIGS. 1–5, mobile mining machine 10 includes right gantry frame 88a and left gantry frame 88b. Right gantry frame 88a and left gantry frame 88b each include a crawler beam 90 which is disposed substantially parallel to the longitudinal axis of mobile mining machine 10. Attached to each end of crawler beam 90 is an upright support 92, which is substantially perpendicular to crawler beam 90. Structural integrity for right gantry frame 88a and left gantry frame 88b is provided by cross beams 94. The ends of upright support 92 remote from crawler beam 90 include frame corners 96. Frame corners 96 anchor front traverse way 52 and rear traverse way 54 to upright supports 92.

Additionally, spanning the one frame corner 96 supporting front traverse way 52 and the other frame corner 96 supporting rear traverse way 54 is synchronizing chain 98, which is meshed with sprockets known in the art with both front traverse screw 64 and rear traverse screw 66 to ensure synchronous rotation thereof. Connected to crawler beams 90 at the intersection of upright supports 92 are gripper arm trunnions 100. Gripper arm trunnions 100 pivotally attach gripper arms 102 to both right gantry frame 88a and left gantry frame 88b. Gripper arms 102 are attached to front right gripper shoe 58a, front left gripper shoe 58b, rear right gripper shoe 62a and rear left gripper shoe 62b by pivot pins 103 such that actuation of front right gripper cylinder 56a, front left gripper cylinder 56b, rear right gripper cylinder 60a and rear left gripper cylinder 60b, as described above, causes pivotal movement of gripper arms 102 and front right gripper shoe 58a and front left gripper shoe 58b, rear right gripper shoe 62a and rear left gripper shoe 62b. In this manner, gripper arms 102 can pivot outwardly relative to mobile mining machine 10 thus contacting front right gripper shoe 58a, front left gripper shoe 58b, rear right gripper shoe 62a and rear left gripper shoe 62b to secure mobile mining machine 10 in the tunnel for mining. Also, gripper arms 102 can pivot inwardly relative to mobile mining machine for tramming.

Gripper arm trunnions 100 straddle screw jacks 104 on crawler beams 90. Screw jacks 104 are preferably machine screws with worm gears model no. 2249 manufactured by Duff-Norton of Charlotte, N.C. Screw jacks 104 include a threaded shaft 106 terminating in a pad 108. Screw jacks 104 are each powered by a hydraulic drive motor 110 known in the art. When screw jacks 104 are in the retracted position, mobile mining machine 10 rests upon crawlers 112 located adjacent to the interior side of right gantry frame 88a and left gantry frame 88b. Crawlers 112 are power tracks that facilitate steering of mobile mining machine 10 by differential tractive effort between the two crawlers 112. As is known, the differential tractive effort may be different track speeds of crawlers 112 in either the same direction or opposite directions. Thus, crawlers 112 allow both tramming of mobile mining machine 10 to alternate locations as well as repositioning of mobile mining machine 10 after a tunneling stroke for a subsequent tunneling stroke. When screw jacks 104 are extended, mobile mining machine 10 is raised such that crawlers 112 no longer support the weight of mobile mining machine 10. Instead, mobile mining machine 10 is supported by screw jacks 104 to facilitate tunneling.

Adjacent screw jacks 104 and facing forwardly on right gantry frame 88a and left gantry frame 88b are muck blade supports 114, which attach muck blades 116 to right gantry frame 88a and left gantry frame 88b.

It is readily apparent that the above described configuration of right gantry frame 88a and left gantry frame 88b in conjunction with forward traverse way 52 and rear traverse way 54 provides a mobile mining machine having a gantry configuration in which an inner portion 118 under mobile mining machine 10 is defined by the above structural components. This inner portion 118 of mobile mining machine 10 is devoid of any structural element, thus allowing for access of inner portion of 118 by workmen, trams, and other mining machinery. Specifically, this inner portion includes a front opening for passage of muck therethrough, and a rear opening for ingress and egress of workers and associated machinery. During mucking, muck blades 116 are angled inwardly towards inner portion 118, as shown in FIG. 2, such that the muck is channeled through the front opening of mobile mining machine 10 and into inner portion 118 where it is then gathered by mucking trams and workers who enter mobile mining machine 10 through the rear opening. The workers and trams then remove the muck through this rear opening of mobile mining machine 10. Dust curtain 130 is preferably divided into a plurality of vertically disposed longitudinal strips that allow easy passage of muck trams and workers for gathering of muck during mucking.

Figure 3:
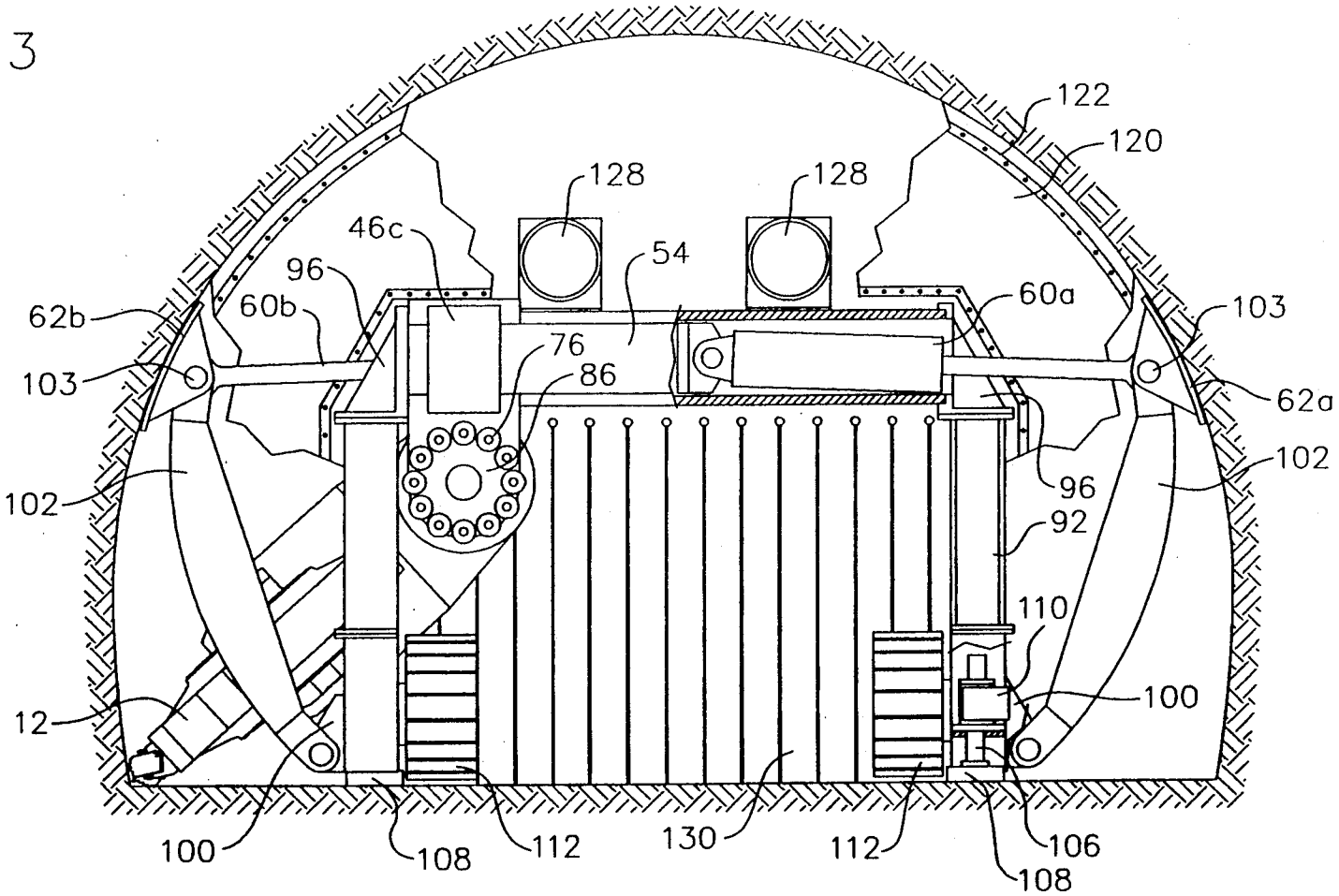
FIG. 3 is a rear view of the mobile mining machine of FIG. 1.
Figure 4:
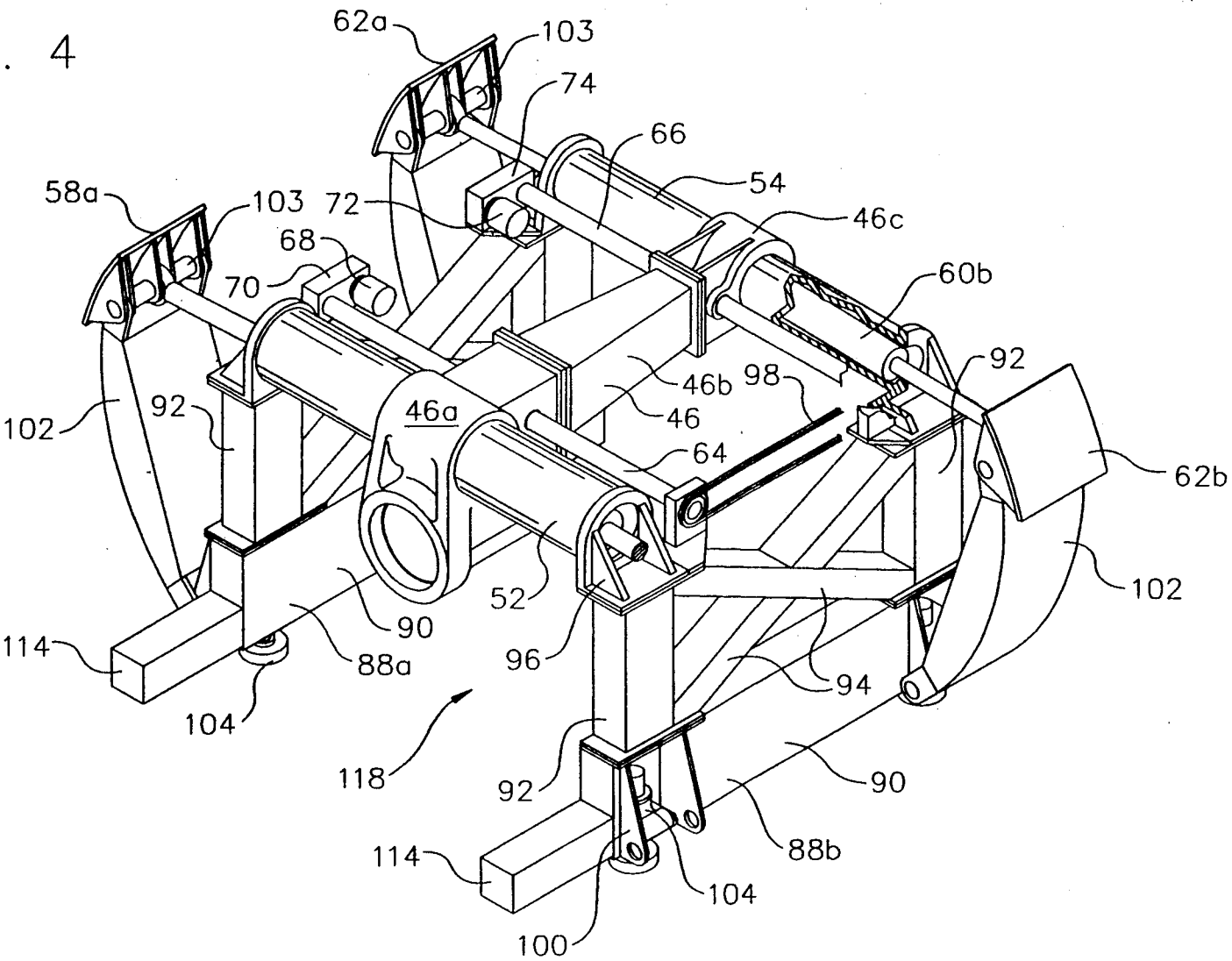
FIG. 4 is a partial perspective view of the traverse housing, traverse ways, and gantry frame of the mobile mining machine of FIG. 1.
Figure 5:
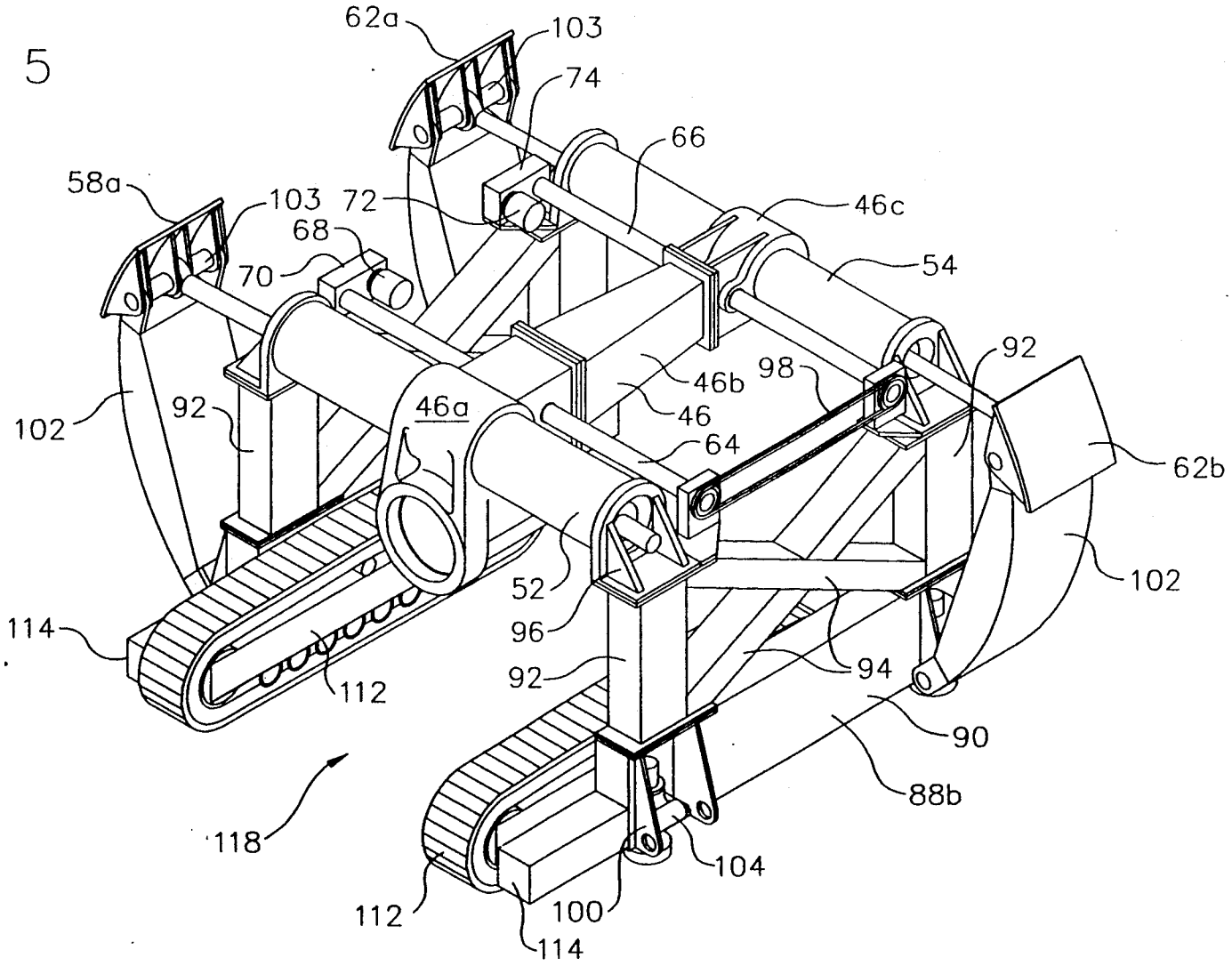
FIG. 5 is a partial perspective view of the traverse housing, traverse ways, gantry frame, and crawlers of the mobile mining machine of FIG. 1.

Next, describing the components of mobile mining machine 10 providing muck handling and general power needs, FIGS. 1–3 show expandable rigid dust shield 120 located on the forward portion of mobile mining machine 10 aft of cutterhead 12. Dust shield 120 includes flexible edge 122 which provides a seal against the tunnel wall for dust shield 120. Communicating with dust shield 120 is forward scrubber duct 124 which, in turn, communicates with scrubber 126. Scrubber 126 also includes aft duct 128 located on the rear portion of mobile mining machine 10. Dust curtain 130 shrouds inner portion 118 and is attached to the forward part of mobile mining machine 10 in the same plane as dust shield 120. Dust curtain 130 prevents dust and other particulate matter from passing through inner portion 118 and into the tunnel area already tunneled aft of mobile mining machine 10.

Adjacent rear traverse way 54 is rear platform 132, which is supported by rear platform brace 134. Rear platform 132 supports hydraulic power unit 136, electrical cabinets 138, diesel generator 140, and operating area 142.

Operation of mobile mining machine 10 is now described. Specifically, mobile mining machine 10 performs a tunneling stroke while in a gripped position in the tunnel and either positions for another tunneling strokes or trams from location to location in an ungripped configuration. As stated above, tunneling is performed with any combination of orbital motion with variable orbital radius and traverse movement of cutterwheel 12.

An exemplary tunneling cycle is now described. First, mobile mining machine 10 trams to the rock face to be cut with crawlers 112 contacting the tunnel floor and screw jacks 104 in the retracted position. The mobile mining machine 10 is trammed to be "on line" in the tunnel, i.e. lined up with the tunnel center line. Next, screw jacks 104 are extended, thus raising mobile mining machine 10 off of crawlers 112 until mobile mining machine 10 is "on the grade", i.e., at desired machine height and boom 20 elevation. Gripper arms 102 and front right gripper shoe 58*a*, front left gripper shoe 58*b*, rear right gripper shoe 62*a* and rear left gripper shoe 62*b* are moved to contact the tunnel wall by extension of front right gripper cylinder 56*a*, front left gripper cylinder 56*b*, rear right gripper cylinder 60*a* and rear left gripper cylinder 60*b*. At this time, boom support shaft 34 is in the retracted position.

The tunneling stroke is initiated by extension of plunging cylinders 76, preferably approximately 0.5 to 1 inches, for example, (the actual penetration depth is to be dictated by rock condition, however) thus extending boom support shaft 34, boom 20 and cutterwheel 12 in the forward direction. To cut a horizontal section of the tunnel face (to cut the tunnel floor) traverse housing 46 moves on forward traverse way 52 and rear traverse way 54 in a horizontal plane to, for example, the left side of mobile mining machine 10 while cutterwheel 12 is oriented downwardly relative to mobile mining machine 10. As previously stated, front traverse screw 64 and rear traverse screw 66, as powered by front traverse motor 68 and rear traverse motor 72, cause the above relative motion of traverse housing 46. At the end of travel of traverse housing 46, cutterwheel 12 is rotated on boom yoke 26 to position cutterwheel 12 outwardly to one side of mobile mining machine 10 to continue the cut of the tunnel floor and to cut the corner of the tunnel at the intersection of the tunnel floor and the tunnel wall. Additionally, to cut this corner, boom 20 is actuated by boom cylinders 30 to orient cutterwheel 12 downwardly into the tunnel corner. Further actuation of boom cylinders 30 moves cutterwheel 12 on boom 20 rearwardly towards mobile mining machine 10 to complete the corner cut. After the corner cut, the tunnel wall is cut by, for example clockwise rotation of cutterwheel 12 around boom yoke 26 such that cutterwheel 12 travels in an arcuate course over mobile mining machine 10. During this arcuate course, cutterwheel 12 may optionally be traversed horizontally to cut a roof with substantially not crown. Then, the arcuate path is finished to form the tunnel wall. Next, the opposite tunnel corner is cut and cutterwheel 12 and boom 20 are again traversed in the same direction (i.e. left) across the tunnel face by motion of traverse housing 46 in a horizontal plane, thus finishing the tunnel floor and returning to the tunnel center. Then, another plunge is made and another complete tunnel face cut is performed in the opposite linear direction (i.e. right) and the opposite arcuate direction (i.e. counterclockwise).

Note that after each complete tunnel face cut is performed, plunge cylinders extend boom shaft support 34, boom 20 and cutterwheel 12 again into the rock tunnel face, thus cutting the tunnel face again. This procedure is repeated until plunge cylinders 76 extend to their full stroke, preferably about 6 to 8 inches.

Gripper arms 102 are then relieved by retraction of front right gripper cylinder 56*a*, front left gripper cylinder 56*b*, rear right gripper cylinder 60*a* and rear left gripper cylinder 60*b*. Screw jacks 104 are retracted off of the tunnel floor, thus lowering mobile mining machine 10 onto crawlers 112. Plunge cylinders 76 are then retracted, thus retracting boom support shaft 34, boom 20, and cutterwheel 12. The crawlers 112 are then employed to either reposition mobile mining machine 10 for another mining stroke, or to tram to another location. The above mining stroke is then repeated. During mining, muck is collected from inner portion 118, as received from muck blades 116, by mucking trams that pass into inner portion 118.

Figure 8:
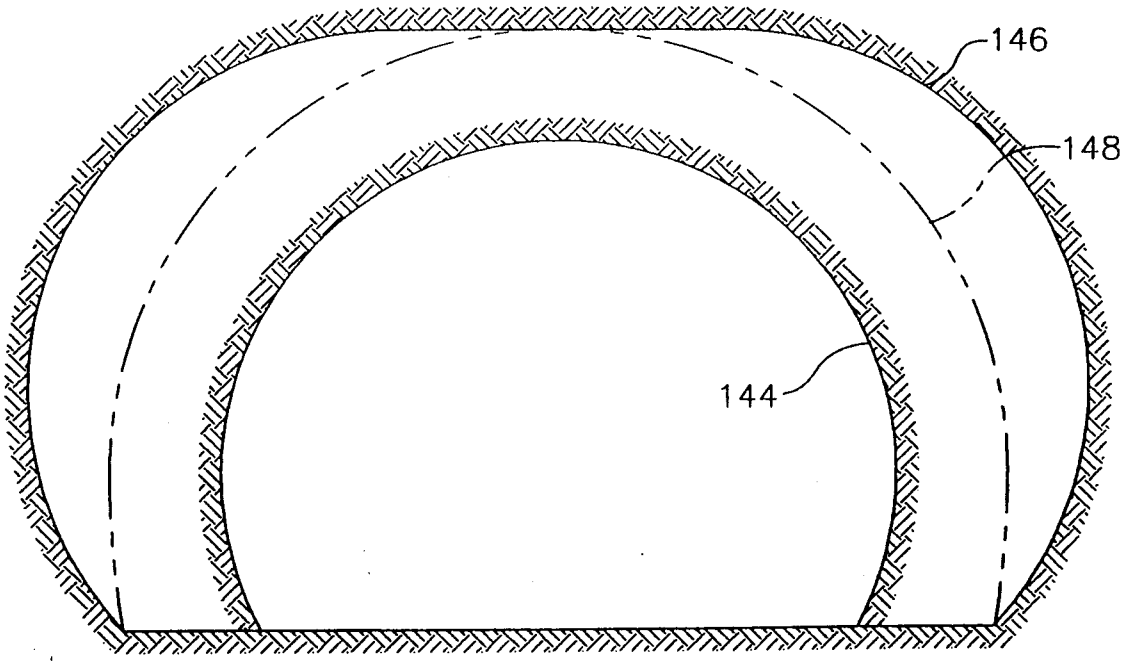
FIG. 8 is a cross-sectional view of the maximum tunnel, minimum tunnel, and an exemplary tunnel cut with the mobile mining machine of FIG. 1.

Referring to FIG. 8, the shapes and relative sizes of the minimum tunnel 144 and the maximum 146 able to be tunneled by mobile mining machine 10 are shown. Tunnel 148 is an exemplary tunnel having a size between that of minimum tunnel 144 and maximum tunnel 146. It is readily apparent, however, that mobile mining machine 10 can cut a tunnel of any shape and size between minimum tunnel 144 and maximum tunnel 146. Minimum tunnel 144 is sized such that mobile mining machine 10 can pass therethrough. Thus, the shape and size of minimum tunnel 144 is dictated by the size of mobile mining machine 10.

Regarding the shape of maximum tunnel 146, this tunnel has a small height to width ratio and optionally may lack any arc in the tunnel crown. The height of maximum tunnel 146 is a function of the length of boom 12 and of the maximum angle of extension of boom 20. This angle of extension is preferably about 45 degrees. The width of maximum tunnel 146 is a function of the length of the horizontal travel of traverse housing 46 and the maximum angle of extension of pitch boom 20 when the axis of cutterwheel 12 is vertically disposed. The roof configuration of maximum tunnel 146 is again a function of the horizontal travel of traverse housing 46. Additionally, this roof configuration is a function of the maximum angle of boom 20 when the axis of cutterwheel 12 is horizontally disposed. Note that the sides of maximum tunnel 146 are not elliptical, but are each a partial radius of a circle because cutterwheel 12 and boom 20 are axially rotated on boom yoke 26, as opposed to the use of a pitch boom in conjunction with a swing boom.

The above described maximum tunnel 146 having a small height to width ratio is cut by mobile mining machine 10 having the optional traverse assembly described above. If traverse movement is absent from mobile mining machine 10, a maximum tunnel having a substantially equal height to width ratio (not shown) is created.

The above described embodiments ar intended to be descriptive, not restrictive. The full scope of the invention is described by the claims, and any and all equivalents are included.

What is claimed is:

1. In a mobile mining machine of the type wherein a cutterwheel is mounted for pivotal movement on boom means and rotated about an axis substantially parallel to the tunnel work face while being swept progressively across the tunnel work face, the improvement wherein said boom means is carried by mounting means enabling pivotal movement of said boom means about an axis generally parallel to said work face and said mounting means is in turn supported by rotatable means rotatable about an axis generally perpendicular to the tunnel work face so that the axis of rotation of the cutterwheel is positionable in any desired direction generally parallel to the work face and a means for causing traverse movement of said cutterwheel and said boom means which is comprised of a forward traverse way and a rear traverse way disposed transverse of said mobile mining machine and a traverse housing slidably mounted over and interconnecting said forward traverse way and rear traverse way.

2. A mobile mining machine for boring a tunnel in rock, comprising:

frame means and associated gripper means for selectively intermittently anchoring the frame in the tunnel being bored as well as associated transport means for intermittently moving the machine along the line of advance as the tunnel progresses;

a power driven cutterwheel mounted on beam means having multiple peripherally mounted roller cutters, said cutterwheel being rotatable about an axis perpendicular to said line of advance and being pivotally movable with respect to said frame about an axis perpendicular to said line of advance; and means mounting said boom means for rotation about an axis parallel to said line of advance and for causing traverse movement of said cutterwheel and said boom means relative to said frame, whereby the cutterwheel is positionable with its axis of rotation extending in any desired direction perpendicularly of said line of advance during boring.

3. A mobile mining machine for boring a tunnel in rock, comprising:

wheel-like cutterwheel assembly means for boring rock, said cutterwheel assembly means including a cutterwheel having multiple peripherally mounted roller cutter units, said cutterwheel having an axis of rotation substantially parallel to the tunnel work face;

first rotation means for rotating said cutterwheel about its axis of rotation;

boom assembly means supporting said cutterwheel assembly means, said boom assembly means enabling radial movement of said cutterwheel relative to its axis of rotation;

second rotation means supporting said boom assembly means, said second rotation means causing rotation of said cutterhead assembly means and said boom assembly means about an axis substantially perpendicular to the axis of rotation of said cutterwheel;

traverse means supporting said second rotation means, said traverse means causing transverse movement of said cutterhead assembly means, said boom assembly means, and said second rotation means across said work face;

frame means supporting said traverse means;

thrust means for thrusting forward as a unit said cutterhead assembly means, said boom assembly means, and said second rotation means relative to said frame means;

holding means for holding said frame means stationary in said tunnel during thrusting by said thrust means; and transport means on said frame means for supporting said frame means for movement of the machine relative to the tunnel work face.

4. The mobile mining machine of claim 3, wherein said second rotation means comprises:

a boom support shaft disposed longitudinally of said mobile mining machine;

a boom yoke rotatably supported on said boom support shaft and supporting said boom assembly means; and motor means interacting between said boom yoke and said boom support shaft for rotation of said boom yoke relative to said boom support shaft.

5. The mobile mining machine of claim 3, wherein said second rotation means comprises:

a boom support shaft disposed longitudinally of said mobile mining machine;

a boom yoke rotatably supported on said boom support shaft by bearing means, said boom yoke supporting said boom assembly means;

ring gear means circumferentially disposed on said boom yoke; and motor means intermeshing with said ring gear means to cause rotation of said boom yoke relative to said boom support shaft.

6. The mobile mining machine of claim 5, wherein said boom support shaft is supported by said transverse means, and said thrust means comprises:

bearing means attaching said boom support shaft to said traverse means for fore and aft reciprocation of said boom support shaft relative to said traverse means; and thrust cylinder means connecting said transverse means and said boom support shaft for forward thrusting of and rearward recovery of said boom support shaft, said second rotation means, said boom assembly means, and said cutterhead assembly means relative to said traverse means.

7. The mobile mining machine of claim 3, wherein said traverse means comprises:

a forward traverse way disposed transverse of said frame means;

a rear traverse way disposed transverse of said frame means;

a traverse housing slidably mounted over and interconnecting said forward traverse way and said rear traverse way;

means for causing traverse movement of said traverse housing over said forward traverse way and said rear traverse way.

8. The mobile mining machine of claim 7, wherein said means for causing traverse movement of said traverse housing comprises:

a forward traverse screw threaded through said traverse housing;

a rear traverse screw threaded through said traverse housing; and motor means for rotation of said forward traverse screw and said rear traverse screw to cause traverse movement of said traverse housing.

9. The mobile mining machine of claim 7, wherein said holding means comprises:

jack means on said frame means for raising and lowering said mobile mining machine;

gripper arms pivotally attached to said frame means;

gripper shoes on said gripper arms;

gripper cylinders in said forward traverse ways and said rear traverse ways, said gripper cylinders attached to said gripper arms adjacent said gripper shoes, said gripper cylinders causing pivotal lateral movement of said gripper arms and said gripper shoes relative to said frame means.

10. A cutterwheel positioning assembly for a mobile mining machine having a frame and a cutterwheel carried by a cutterwheel positioning assembly supported on said frame, said cutterwheel positioning assembly comprising:

boom assembly means supporting said cutterwheel for rotation about an axis of rotation transverse to the fore and aft axis of said frame, said boom assembly means in turn being supported for pivotal movement relative to said frame about an axis transverse to the fore and aft axis of said frame;

rotation means for said boom assembly means and said cutterwheel rotating same relative to said frame about an axis parallel to the fore and aft axis of said frame, causing orbital movement of said cutterwheel and said boom assembly relative to such fore and aft axis; and means for causing traverse movement of said cutterwheel and said boom assembly means comprised of a forward traverse way and a rear traverse way disposed transverse of said frame and a traverse housing slidably mounted over and interconnecting said forward traverse way and said rear traverse way.

11. A cutterhead positioning assembly according to claim 10, wherein the rotation means comprises:

a boom support shaft disposed with a longitudinal dimension thereof extending fore and aft on said frame;

a boom yoke rotatably carried by said boom support shaft and in turn supporting said boom assembly; and motor means interacting between said boom yoke and said shaft for rotation of said boom yoke relative to said boom support shaft.

12. The cutterhead positioning assembly of claim 10, wherein said rotation means comprises:

a boom support shaft extending fore and aft of said mobile mining machine;

a boom yoke rotatably carried by said boom support shaft by bearing means, said boom yoke supporting said pitch boom assembly means;

gear means radially disposed on said boom yoke; and motor means intermeshing with said gear means to cause rotation of said boom yoke relative to said boom support shaft.

13. The cutterhead positioning assembly of claim 10, wherein said means for causing transverse movement of said traverse housing comprises:

a forward traverse screw threaded said traverse housing;

a rear traverse screw threaded through said traverse housing; and motor means for rotating said forward traverse screw and said rear traverse screw to cause transverse movement of said traverse housing.

14. A gantry mobile mining machine for boring a tunnel in a rock work face, comprising:

wheel-like cutterwheel assembly means for boring rock, said cutterwheel assembly means having a multiple peripherally mounted roller cutter units, said cutterwheel assembly means having an axis of rotation extending generally parallel to said work face;

rotation means for rotating said cutterwheel assembly means about its axis of rotation;

cutterwheel positioning means supporting said cutterwheel assembly means, said cutterwheel assembly means permitting positioning of said cutterwheel assembly means to place the axis of rotation of the cutterwheel in any desired direction substantially parallel to said work face, said cutterwheel position means including a boom means carried by mounting means enabling pivotal movement of said boom means, and means for causing traverse movement of said cutterwheel and said boom means comprised of a forward traverse way and a rear traverse way disposed transverse of said mobile mining machine and a traverse housing slidably mounted over and interconnecting said forward traverse way and rear traverse way;

thrust means for thrusting said cutterwheel assembly means forward relative to said work face;

holding means for holding stationary said mobile mining machine during thrusting of said cutterwheel assembly means by said thrusting means; and gantry frame means supporting said cutterwheel positioning assembly means, said gantry frame means having said holding means attached thereto, said gantry frame means including a first gantry side frame portion, a second gantry side frame portion, and a top gantry frame portion connecting said first gantry side frame portion and said second gantry side frame portion to define a void under said mobile mining machine with a front opening for passage of muck therethrough and a rear opening for ingress and egress of workers and associated machinery.

15. The gantry mobile mining machine of claim 14, further comprising:

muck apson assembly means attached to said gantry frame means, said muck apron assembly means adapted to guide muck through said front opening and into the void defined by said gantry frame means.

16. The gantry mobile mining machine of claim 14, wherein said muck apron assembly means comprises:

a first muck blade attached to said first gantry side frame portion; and a second muck blade attached to said second gantry frame side portion, each of said first muck blade and said second muck blade being disposed at an angle from the fore and aft axis of said mobile mining machine to guide muck through said front opening of the void defined by said gantry frame means.

17. In a mobile mining machine having a frame and of the type wherein a cutterwheel is mounted for pivotal movement on boom means and rotated about an axis substantially parallel to the tunnel work face while being swept progressively across the tunnel work face, the improvement wherein said boom means is carried by mounting means enabling pivotal movement of said boom means about an axis generally parallel to said work face and said mounting means is in turn supported by rotatable means rotatable about an axis generally perpendicular to the tunnel work face so that the axis of rotation of the cutterwheel is positionable in any desired direction generally parallel to the work face and means mounted on said frame for causing traverse movement of said cutterwheel and said boom means relative to said frame.

18. A gantry mobile mining machine for boring a tunnel in a rock work face, comprising:

wheel-like cutterwheel assembly means for boring rock, said cutterwheel assembly means having a multiple peripherally mounted roller cutter units, said cutterwheel assembly means having an axis of rotation extending generally parallel to said work face;

rotation means for rotating said cutterwheel assembly means about its axis of rotation;

cutterwheel positioning means supporting said cutterwheel assembly means, said cutterwheel positioning means permitting positioning of said cutterwheel assembly means to place the axis of rotation of the cutterwheel in any desired direction substantially parallel to said work face, said cutterwheel positioning means including boom means carried by mounting means enabling pivotal movement of said boom means, and means for causing traverse movement of said cutterwheel and said boom means relative to said mounting means;

thrust means for thrusting said cutterwheel assembly means forward relative to said work face;

holding means for holding stationary said mobile mining machine during thrusting of said cutterwheel assembly means by said thrusting means; and gantry frame means supporting said cutterwheel positioning assembly means and having said means for causing traverse movement of said cutterwheel and said boom means mounted thereon, said gantry frame means having said holding means attached thereto, said gantry frame means including a first gantry side frame portion, a second gantry side frame portion, and a top gantry frame portion connecting said first gantry side frame portion and said second gantry side frame portion to define a void under said mobile mining machine with a front opening for passage of muck therethrough and a rear opening for ingress and egress of workers and associated machinery.

19. A cutterwheel positioning assembly for a mobile mining machine having a frame and a cutterwheel carried by a cutterwheel positioning assembly supported on said frame, said cutterwheel positioning assembly comprising:

boom assembly means supporting said cutterwheel for rotation about an axis of rotation transverse to the fore and aft axis of said frame, said boom assembly means in turn being supported for pivotal movement relative to said frame about an axis transverse to the fore and aft axis of said frame;

rotation means for said boom assembly means and said cutterwheel rotating same relative to said frame about an axis parallel to the fore and aft axis of said frame, causing orbital movement of said cutterwheel and said boom assembly relative to such fore and aft axis; and means mounted on said frame for causing traverse movement of said cutterwheel and said boom assembly means relative to said frame.

* * * * *